US005980135A

United States Patent [19]

Shih-Hung

[11] Patent Number: 5,980,135

[45] Date of Patent: Nov. 9, 1999

[54] KEYBOARD WITH AN OPTIONAL METAL SUPPORT FOR STRENGTHENING ITS STRUCTURE

[75] Inventor: Chao Shih-Hung, Pan-Chiao, Taiwan

[73] Assignee: Acer Peripherals, Inc., Kweishan, Taiwan

[21] Appl. No.: 09/159,440

[22] Filed: Sep. 22, 1998

[51] Int. Cl.[6] ..... B41J 5/12; H01H 13/70

[52] U.S. Cl. ..... 400/479; 200/517; 200/344; 200/5 A

[58] Field of Search ..... 400/479, 479.1, 400/479.2, 495, 472; 200/5 A, 512, 513, 517, 344

[56] References Cited

U.S. PATENT DOCUMENTS

| | | | |
|---|---|---|---|
| 4,375,585 | 3/1983 | Lee | 200/5 A |
| 4,532,575 | 7/1985 | Suwa | 200/5 A |
| 4,555,601 | 11/1985 | Taguchi | 200/5 A |
| 5,278,372 | 1/1994 | Takagi et al. | 200/344 |
| 5,574,446 | 11/1996 | Dittrich et al. | 341/22 |
| 5,630,501 | 5/1997 | Tsay | 200/344 |
| 5,738,450 | 4/1998 | Lukosch | 400/479 |

*Primary Examiner*—Edgar Burr
*Assistant Examiner*—Leslie J. Grohusky
*Attorney, Agent, or Firm*—Winston Hsu

[57] ABSTRACT

The present invention provides a keyboard which can take an optional metal support for strengthening its structure. It comprises a cover plate with a plurality of vertical housings, a base plate mounted on the cover plate with a plurality of protruding pads installed under the vertical housings of the cover plate, a plurality of keys that are vertically and movably installed within the vertical housings, a membrane installed between the cover plate and the base plate comprising a plurality of switches. When any key is depressed, the underlying switch is pressed between the plunger of the key and the underlying protruding pad, and generates a corresponding sensing signal. The keyboard may also comprise a metal support installed between the cover plate and the base plate for increasing structural strength.

8 Claims, 4 Drawing Sheets

KEYBOARD WITH AN OPTIONAL METAL SUPPORT FOR STRENGTHENING ITS STRUCTURE

BACKGROUND OF THE INVENTION

1. Field of the Invention

The present invention relates to a keyboard, and more particularly, to a keyboard with an optional metal support for strengthening its structure.

2. Description of the Prior Art

A typical computer keyboard comprises a base plate, a cover plate mounted above the base plate with a plurality of movable keys installed on top, and a membrane installed between the base plate and the cover plate for sensing depression of the overlying keys. Some keyboards further comprise a metal support for increasing structural strength and quality. As this may be costly, some computers forego the metal support in the interest of cost savings.

The metal support, if present, serves to support the membrane as the overlying keys are depressed. Therefore, the base plate must be specially designed to accommodate the metal support. If this base plate is then used for a keyboard without the metal support, an empty space is left by the missing metal support between the base plate and the cover plate causing a loss of support of the membrane and subsequent improper key functioning. A solution to this problem is to create a new mold for a thinner base plate thereby directly supporting the membrane. However, this solution drives costs unacceptably high. An alternate solution is to produce an array of protruding ribs on the original mold of the base plate used for keyboards with the metal support. Unfortunately, although these ribs give support to the membrane, they also permanently interfere with installation of the metal support when needed.

SUMMARY OF THE INVENTION

It is therefore a primary objective of the present invention to provide a keyboard independent of the presence or absence of the metal support.

In a preferred embodiment, the present invention provides a keyboard comprising:

a cover plate with a plurality of support structures and a plurality of key caps wherein the bottom side of each of the key caps is installed on each of the support structures and is movable in up and down directions;

a base plate mounted under the cover plate having a plurality of protruding pads positioned under the key caps of the cover plate;

a membrane mounted between the cover plate and the base plate comprising a plurality of switches each positioned between one of the key caps of the cover plate and one of the protruding pads of the base plate for sensing depressions of the key cap;

wherein each of the support structures is a vertical housing installed on the cover plate, and each of the key caps comprises a vertical plunger at the bottom side of the key cap vertically and movably mounted in the vertical housing of the correspondent support structure. When any of the key caps is depressed, the underlying switch is pressed between the key cap and the underlying protruding pad, and generates a corresponding sensing signal.

It is an advantage of the present invention that the keyboard is independent of the presence or absence of the metal support therefore improving the flexibility of using the keyboard.

This and other objectives of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
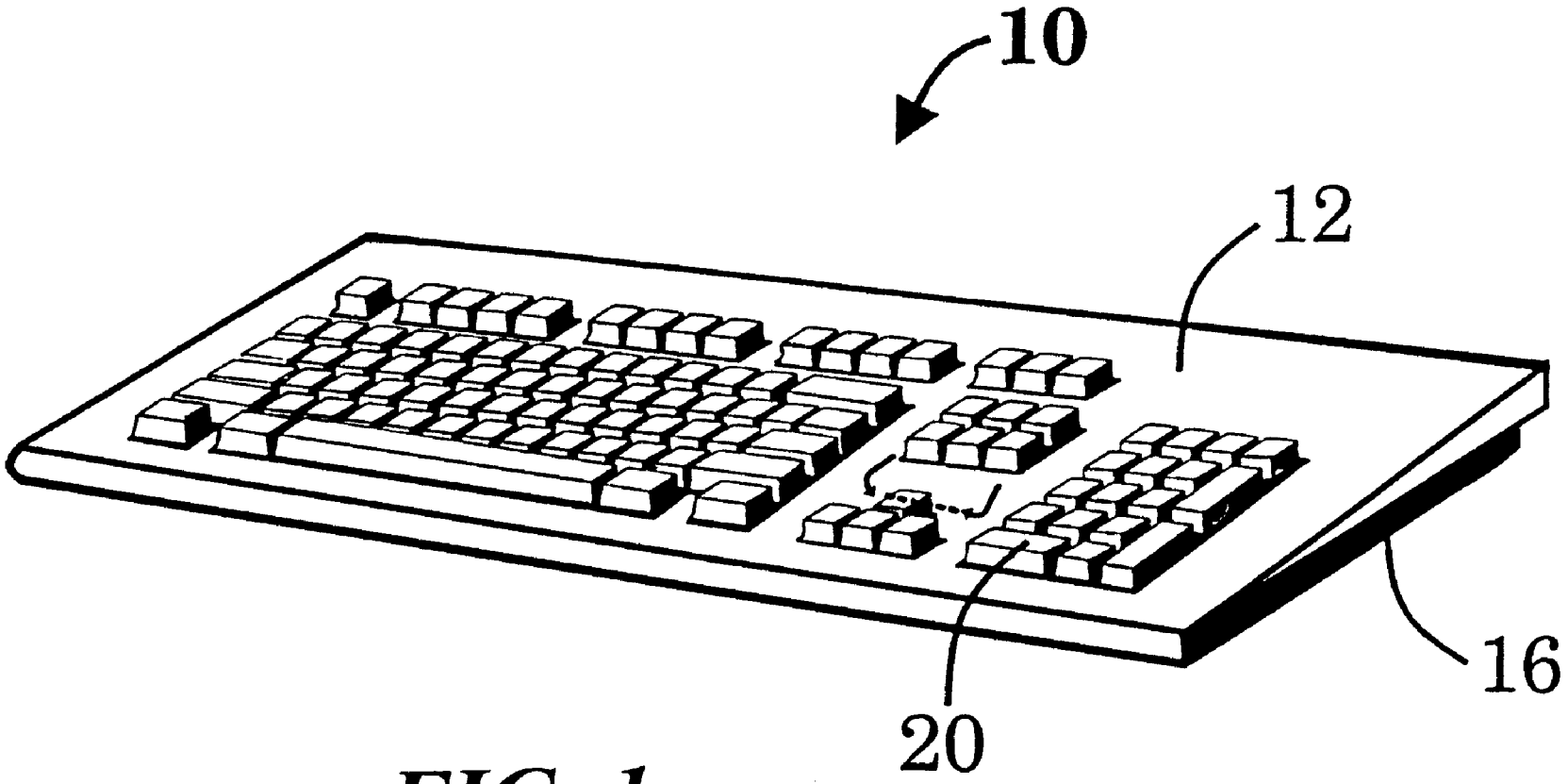
FIG. 1 is a perspective diagram of a computer keyboard according to the present invention.
Figure 2:
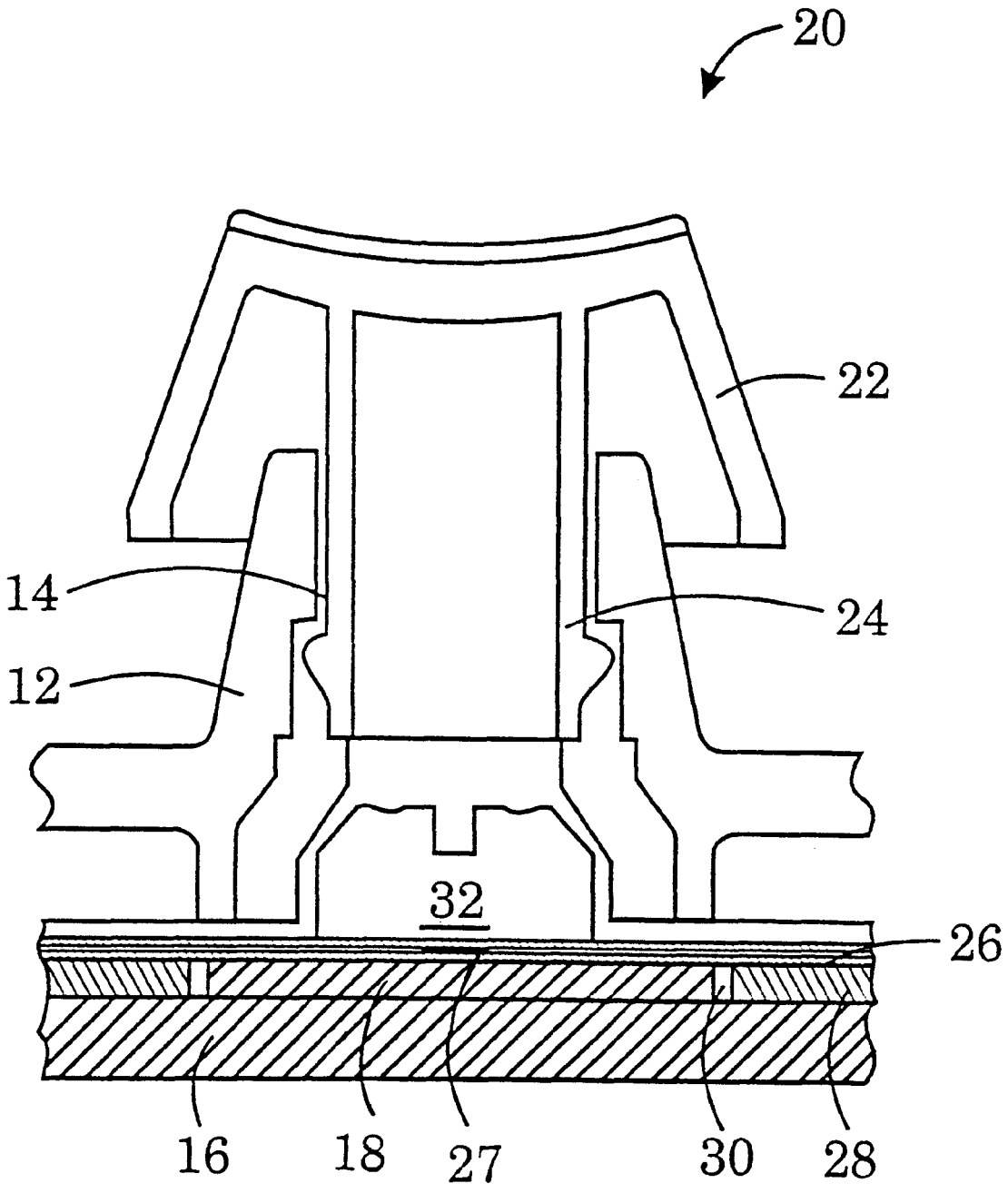
FIG. 2 is a sectional view along line 1—1 of the keyboard shown in FIG. 1.
Figure 3:
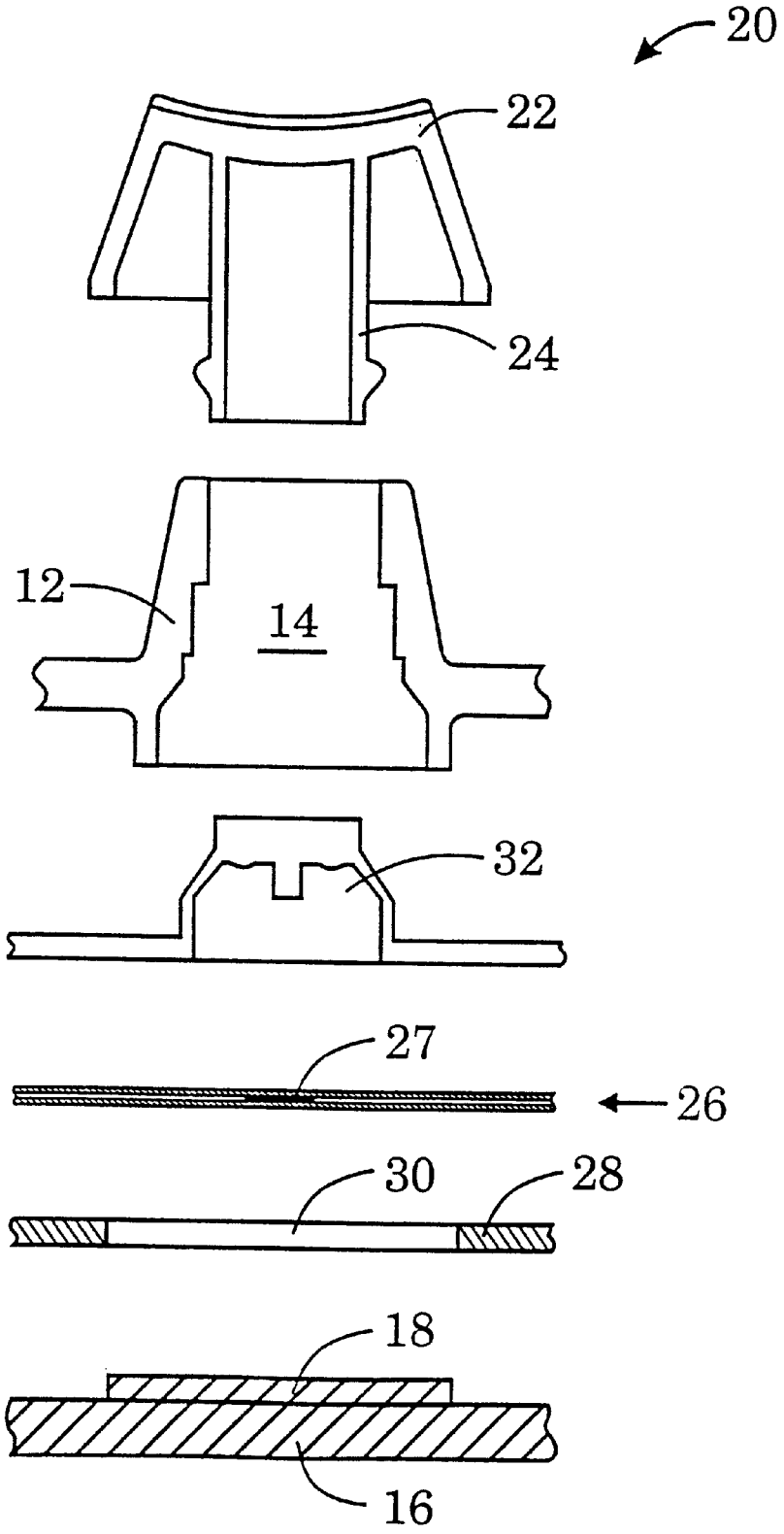
FIG. 3 is a component diagram of a portion of the keyboard shown in FIG. 1.

Please refer to FIG. 1, FIG. 2 and FIG. 3. FIG. 1 is a perspective diagram of a keyboard 10 according to the present invention. FIG. 2 is a sectional view along line 1—1 of the keyboard 10 shown in FIG. 1. And FIG. 3 is a component diagram of a portion of the keyboard shown in FIG. 1. The keyboard 10 comprises a cover plate 12 on which there is a plurality of vertical housings 14, a base plate 16 mounted on the cover plate 12 on which there is a plurality of protruding pads 18 positioned under the vertical housings, a plurality of keys 20 installed in the vertical housings 14, a membrane 26 installed between the cover plate 12 and the base plate 16 for sensing depression of the keys 20, and a metal support 28 installed between the cover plate 12 and the base plate 16 for increasing structural strength.

Each of the keys 20 comprises a vertically plunger 24 which is slidably received in the vertical housing 14, a key cap formed at the top of each plunger 24, and a half-ball shaped rubber piece 32 installed at the bottom end of the plunger 24 in contact with the membrane 26. There is a plurality of switches 27 on the membrane 26 located between each vertical housing 14 and protruding pad 18 for sensing depression of the keys 20. The metal support 28 comprises a plurality of holes 30 each corresponding to the vertical housing 14 and the protruding pad 18. Each of the protruding pads 18 on the base plate 16 projects from a hole 30 on the metal support 28 and provides a base for the switches 27 within the membrane 26.

When any of the keys 20 of the keyboard 10 is depressed, the underlying switch 27 is pressed between the rubber piece 32 and the underlying protruding pad 18. This generates a corresponding sensing signal. Afterward, the rubber piece 32 and the key 20 will return to their original positions.

Figure 4:
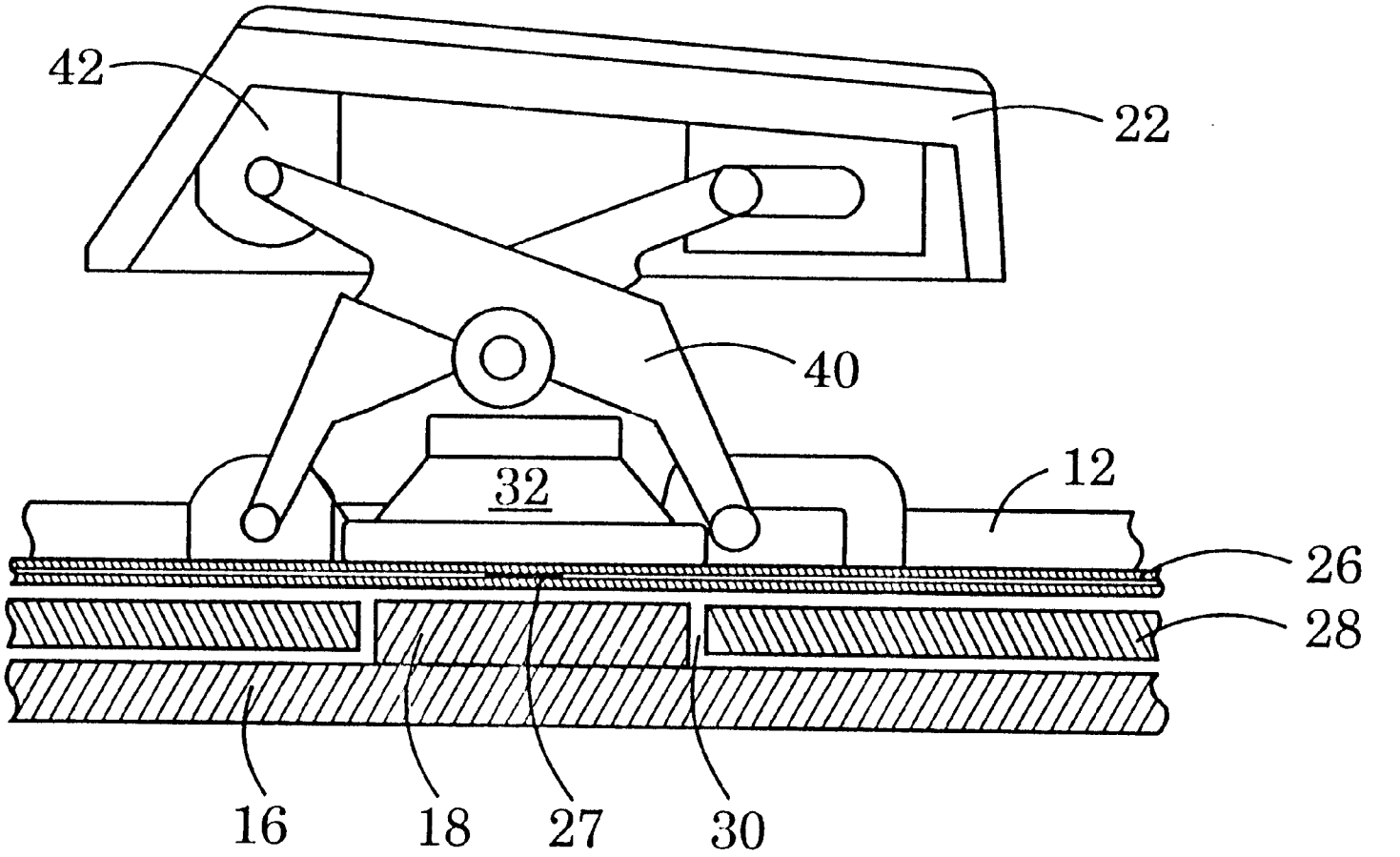
FIG. 4 is a schematic diagram of another embodiment according to the present invention.

In the above mentioned embodiment, the vertical housing 14 is used as a support structure for the key 20. The bottom side of each of the key caps is installed in each of the support structures and is movable in up and down directions. The present invention can also be applied to another scissors-type supporting structure. Please refer to FIG. 4. FIG. 4 is a schematic diagram of an embodiment of another supporting structure. The cover plate 12 comprises a support structure which is a scissors-type framework 40 vertically and movably installed on the cover plate 12. The key cap 22 of the key 20 comprises four clasps 42 securing the scissors-type framework 40 to enable the key 20 to move up and down on the cover plate 12.

As opposed to the keyboards of the prior art, in the present invention, the parts of the keyboard 10 are supported by a plurality of protruding pads 18 of the base plate 16. The metal support 28 can be easily attached to the base plate 16 for increased structural strength and may be removed without significant change to any other part. Therefore, keyboard manufacturers may use the same base plate 16 without alterations regardless of whether the customer needs a metal support in the keyboard 10.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A keyboard comprising:

a cover plate with a plurality of support structures and a plurality of key caps wherein the bottom side of each of the key caps is installed on each of the support structures and is movable in up and down directions;

a base plate mounted under the cover plate having a plurality of protruding pads positioned under the key caps of the cover plate; and a membrane mounted between the cover plate and the base plate comprising a plurality of switches each positioned between one of the key caps of the cover plate and one of the protruding pads of the base plate for sensing depressions of the key cap;

wherein when any of the key caps is depressed, the underlying switch is pressed between the key cap and the underlying protruding pad, and generates a corresponding sensing signal.

2. The keyboard of claim 1 further comprising a metal support installed between the cover plate and the base plate for increasing structural strength of the keyboard wherein the metal support comprises a plurality of holes from which the protruding pads of the base plate project and allowing the switches of the membrane to use the protruding pads as a base.

3. The keyboard of claim 1 wherein each of the support structures is a vertical housing installed on the cover plate, and each of the key caps comprises a vertical plunger at the bottom side of the key cap vertically and movably mounted in the vertical housing of the corresponding support structure.

4. The keyboard of claim 1 wherein the support structure is a scissors-type framework vertically and movably installed on the cover plate, and each of the key caps comprises a plurality of clasps for securing the key cap on the scissors-type framework.

5. A key structure comprising:

a base plate comprising at least one protruding pad installed on it;

a membrane installed above the base plate, the membrane comprising a switch installed within positioned corresponding to the position of the protruding pad;

a rubber piece installed above the membrane, the rubber piece forming a half-ball shaped protruding portion at a position corresponding to the position of the switch;

a cover plate installed on the rubber piece, the cover plate comprising a vertical housing installed at a position corresponding to the half-ball shaped protruding portion;

a key slidably installed in the vertical housing wherein the key is supported by the protruding portion thus is up-and-down moveable, when the key is depressed, the switch will be supported by the protruding pad and thus triggered by the depression of the key.

6. The key structure of claim 5 further comprising a metal support with a hole wherein the metal support is installed between the membrane and the base plate for strengthening the key structure, and the protruding pad will penetrate through the hole upward so that the switch can be supported by the protruding pad.

7. A key structure comprising:

a base plate comprising at least one protruding pad installed on it;

a membrane installed above the base plate, the membrane comprising a switch installed within positioned corresponding to the position of the protruding pad;

a rubber piece installed above the membrane, the rubber piece forming a half-ball shaped protruding portion at a position corresponding to the position of the switch;

a cover plate installed on the rubber piece, the cover plate comprising a scissors-type supporting structure installed at a position corresponding to the half-ball shaped protruding portion;

a key comprising a plurality of clasps wherein the key is installed on the scissors-type supporting structure through the clasps, and is supported by the half-ball shaped protruding portion thus is up-and-down moveable, when the key is depressed, the switch will be supported by the protruding pad and thus triggered by the depression of the key.

8. The key structure of claim 7 further comprising a metal support with a hole wherein the metal support is installed between the membrane and the base plate for strengthening the key structure, and the protruding pad will penetrate through the hole upward so that the switch can be supported by the protruding pad.

* * * * *